US005207556A

United States Patent [19]

Frederick et al.

[11] Patent Number: 5,207,556

[45] Date of Patent: May 4, 1993

[54] AIRFOIL HAVING MULTI-PASSAGE BAFFLE

[75] Inventors: Robert A. Frederick; Mark S. Honkomp, both of Cincinnati, Ohio

[73] Assignee: General Electric Company, Cincinnati, Ohio

[21] Appl. No.: 873,858

[22] Filed: Apr. 27, 1992

[51] Int. Cl.[5] ..... F01D 5/08

[52] U.S. Cl. ..... 415/115; 415/116; 416/96 A

[58] Field of Search ..... 415/115, 116; 416/95, 416/96 R, 96 A, 97 R

[56] References Cited

U.S. PATENT DOCUMENTS

| | | | |
|---|---|---|---|
| 3,475,107 | 10/1969 | Auxier | 415/115 |
| 3,540,810 | 11/1970 | Kercher | 415/115 |
| 3,767,322 | 10/1973 | Durgin et al. | 415/115 |
| 3,781,129 | 12/1973 | Aspinwall | 416/97 |
| 3,867,068 | 2/1975 | Corsmeier et al. | 416/96 A |
| 4,056,332 | 11/1977 | Meloni | 416/97 A |
| 4,252,501 | 2/1981 | Peill | 415/115 |
| 4,257,734 | 3/1981 | Guy et al. | 416/96 A |
| 4,413,949 | 11/1983 | Scott | 416/96 A |
| 4,798,515 | 1/1989 | Hsia et al. | 414/115 |
| 4,930,980 | 6/1990 | North et al. | 415/115 |

OTHER PUBLICATIONS

European Pat. 392,664 Oct. 1990.

*Primary Examiner*—John T. Kwon

*Attorney, Agent, or Firm*—Jerome C. Squillaro

[57] ABSTRACT

A hollow impingement baffle includes a septum extending between its bottom and top and spaced between its forward and aft edges to define a forward manifold and an aft manifold. The baffle includes an inlet having a forward portion for channeling a first portion of compressed air to the forward manifold, and an aft portion for channeling a second portion of the compressed air into the aft manifold with a predetermined pressure drop for obtaining a lower pressure in the aft manifold relative to a higher pressure in the forward manifold. The baffle includes impingement holes for discharging the compressed air against the inner surface of a surrounding airfoil for the impingement cooling thereof.

9 Claims, 3 Drawing Sheets

AIRFOIL HAVING MULTI-PASSAGE BAFFLE

The present invention relates generally to gas turbine engines, and, more specifically, to impingement cooled airfoils therein.

BACKGROUND OF THE INVENTION

A gas turbine engine includes a compressor for providing compressed air which is mixed with fuel in a combustor and ignited for generating combustion gases which flow through a turbine for generating power. The turbine includes one or more stages, with each stage including a plurality of circumferentially spaced rotor blades extending from a disc which is in turn joined to a shaft for providing power to the compressor, for example. Disposed upstream of each rotor blade stage is a turbine nozzle including a plurality of circumferentially spaced stator vanes for suitably channeling the combustion gases to the respective rotor blades.

The stator vanes and rotor blades are conventionally cooled using a portion of the compressed air to provide acceptable life in operation under the adverse affects of the hot combustion gases. Depending upon the designed-for combustion gas temperatures generated by the combustor, various types of cooling schemes are used for effectively cooling the vanes and blades. Such schemes include conventionally known film cooling wherein a plurality of film cooling apertures are disposed through the airfoils of the vanes and blades, and the compressed air is channeled through the airfoils and out the holes for effecting a layer of film cooling air along the outer surface of the airfoils which provides a barrier against the combustion gases flowable thereover. Since the leading edge of the airfoil is typically subject to the highest heat transfer coefficient it therefore experiences the highest heat flux into the airfoil thusly requiring a correspondingly greater amount of heat transfer therefrom for providing effective cooling thereof. And, since downstream of the airfoil leading edge the heat flux decreases, less heat transfer is required for the effective cooling thereof.

In another cooling scheme, a conventional hollow impingement baffle is disposed inside the airfoil and spaced away from the inner surface thereof, with the baffle including impingement holes sized for effecting impingement jets of cooling air against the inner surface of the airfoil for providing impingement cooling thereof. The spent impingement air is then discharged from the airfoil either through the film cooling holes therethrough, or through conventional trailing edge apertures, for example.

Again, the greatest amount of cooling or heat transfer is required in the high heat flux leading edge region as compared to low heat flux region near the airfoil mid-chord, for example. Such heat transfer may be obtained by using impingement cooling, or film cooling, or both in accordance with conventional practice.

However, with a single supply pressure of the cooling air to a hollow airfoil, it is difficult to simultaneously provide adequate cooling of the high heat flux leading edge region and uniform cooling of the low heat flux mid-chord region extending downstream therefrom with reduced total airflow.

For example, impingement cooling requires a given, relatively high pressure ratio across the impingement baffle to drive the cooling air through the impingement holes in impingement against the airfoil inner surface to match the highest heat flux region at the leading edge. Since the pressure ratio across the baffle is driven by the supply pressure on its inside relative to the discharge pressure on its outside, the single, high supply pressure required for the high heat flux region leads to a compromise for the low heat flux region.

More specifically, impingement jet cooling is a function of the hole density, or number of holes per unit area, and the driving pressure ratio thereacross which will effect a specific average metal temperature of the airfoil. Most cooling from an impingement jet is located directly below an impingement hole with least cooling occurring between adjacent holes. Impingement jet cooling therefore effects local variations in airfoil temperature in a generally sinusoidal pattern from jet-to-jet with a resulting average temperature due thereto. The variations are referred to as hot and cold spots associated with the airfoil between and below the impingement holes, respectively.

In designing effective cooling of the airfoil, the difference in temperature between the hot and cold spots should be as low as possible for obtaining a desired average temperature since the hot and cold spots can decrease the effective useful life of the airfoil. By increasing the hole density, both the average metal temperature and the difference in magnitude between the hot and cold spots may be reduced but at the expense of an increase in total cooling airflow channeled through the increased collective flow area of the higher density holes.

However, compressor air used for cooling the airfoils necessarily decreases overall efficiency of the gas turbine engine since it is being used for cooling purposes and does not undergo combustion with the attendant power generation therefrom. Accordingly, conventional cooling schemes utilize as few cooling air apertures as practical for minimizing the required amount of cooling air while still providing effective average cooling of the airfoil without unacceptably high temperature fluctuations between cooling holes.

With a given pressure ratio across the impingement baffle, and with a common supply pressure of the compressed air to the inside of the baffle, the hole density may be preselected to ensure adequate average cooling of the high heat flux region adjacent the leading edge which, however, provides overcooling of the airfoil downstream of the leading edge for a hole density selected to limit hot and cold spots. Alternatively, if the hole density is selectively decreased downstream of the leading edge to provide a lower heat transfer and less cooling thereof to prevent overcooling, the temperature variations between adjacent holes increases for a given desired average metal temperature thus increasing the difference in hot and cold spots. The overcooled high-density hole option wastes cooling air, while the low-density hole option increases thermally induced fatigue which may reduce the effective useful life of the airfoil. So a compromise is typically used to vary the hole density to reduce the overcooling at the expense of increased hot and cold spots.

OBJECTS OF THE INVENTION

Accordingly, one object of the present invention is to provide a new and improved airfoil having an impingement baffle for more effectively utilizing compressed cooling air.

Another object of the present invention is to provide a new and improved impingement baffle effective for obtaining a plurality of pressure ratios over the impingement holes thereof corresponding to differing heat flux regions.

Another object of the present invention is to provide an impingement baffle for effectively cooling a region of high heat flux as well as a region of low heat flux without overcooling thereof.

Another object of the present invention is to provide an impingement baffle effective for reducing hot and cold spot differences in the airfoil while maintaining a predetermined average temperature thereof.

SUMMARY OF THE INVENTION

A hollow impingement baffle includes a septum extending between its bottom and top and spaced between its forward and aft edges to define a forward manifold and an aft manifold. The baffle includes an inlet having a forward portion for channeling a first portion of compressed air to the forward manifold, and an aft portion for channeling a second portion of the compressed air into the aft manifold with a predetermined pressure drop for obtaining a lower pressure in the aft manifold relative to a higher pressure in the forward manifold. The baffle includes impingement holes for discharging the compressed air against the inner surface of a surrounding airfoil for the impingement cooling thereof.

BRIEF DESCRIPTION OF THE DRAWING

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
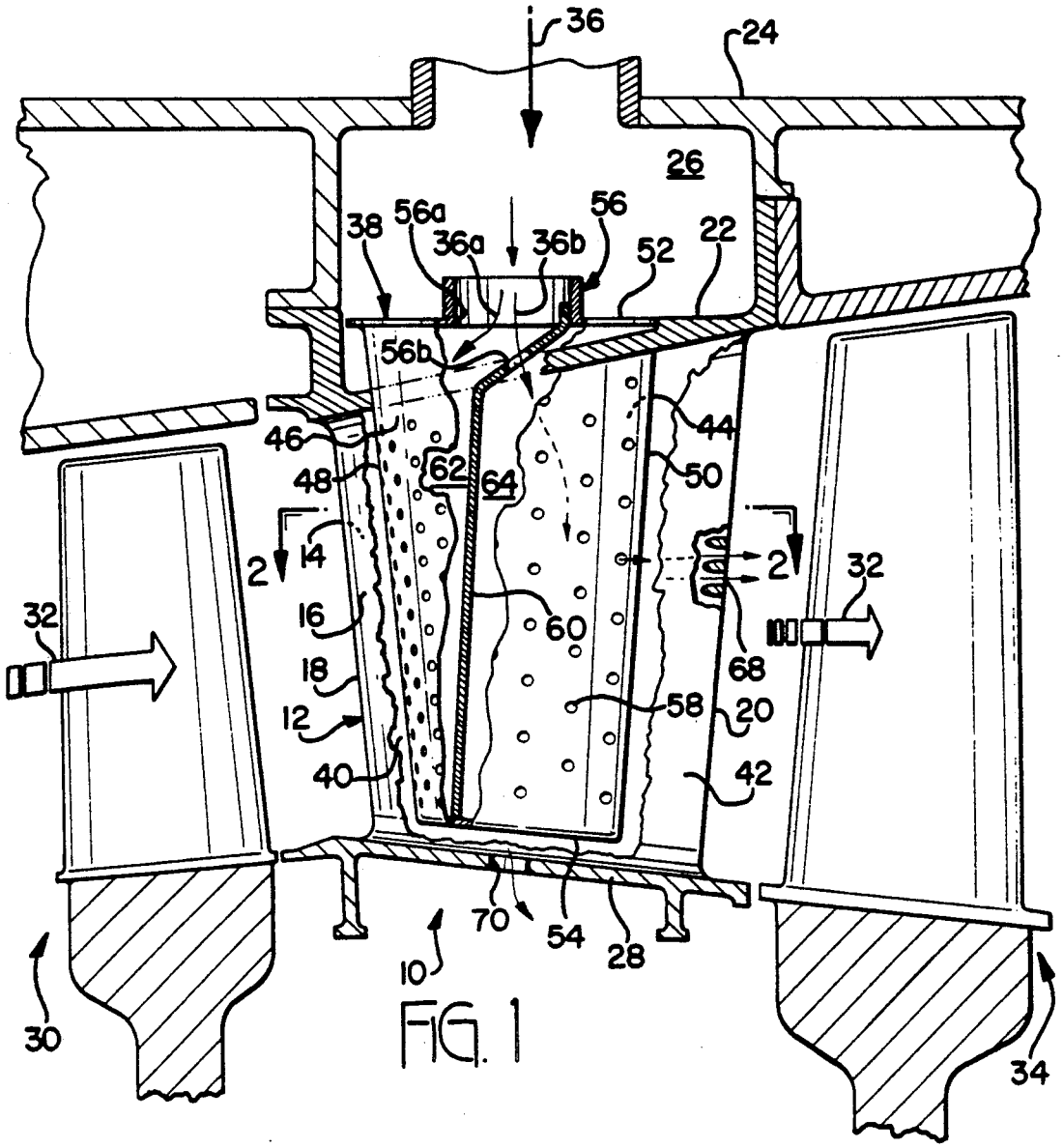
FIG. 1 is an axial, party sectional view of a portion of a gas turbine engine turbine nozzle disposed axially between rotor blade stages.

Illustrated in FIG. 1 is an exemplary second stage annular turbine nozzle 10 including a plurality of circumferentially spaced apart stator vanes or airfoils 12. The vanes 12 are conventional and include a first or concave side 14, as additionally shown in FIG. 2, and a second, or convex side 16 joined together at a leading edge 18 and a trailing edge 20. Each of the vanes 12 also includes a radially outer band or shroud 22 conventionally joined to an annular outer casing 24 to define an annular plenum 26 therebetween. A radially inner band or shroud 28 is disposed at the opposite end of the vane 12.

Disposed immediately upstream of the stage-two nozzle 10 is a conventional first stage turbine 30 having a plurality of circumferentially spaced apart rotor blades between which are conventionally channeled combustion gases 32 received in turn from a conventional first stage nozzle and combustor (not shown). Disposed immediately downstream of the stage-two nozzle 10 is a conventional second stage turbine 34 which includes a plurality of circumferentially spaced apart rotor blades between which are channeled the combustion gases 32 from the stage-two nozzle 10.

In order to cool the nozzle 10 from the heating effects of the combustion gases 32, compressed cooling air 36 is conventionally channeled through the casing 24 and to the nozzle 10 from a conventional compressor (not shown). In accordance with a preferred and exemplary embodiment of the present invention, a hollow impingement baffle or tube insert 38 is conventionally supported inside each of the airfoils 12 for providing impingement cooling of the inner surface 40 thereof. The outer, opposite, surface 42 of the airfoil 12 is heated by the combustion gases 32 which flow thereover, and therefore, the impingement baffle 38 is provided to cool the inner surface 40 for maintaining the average temperature of the airfoil 12 at predeterminedly low values to ensure an effective usage life of the airfoils 12 during operation in the gas turbine engine.

Figure 2:
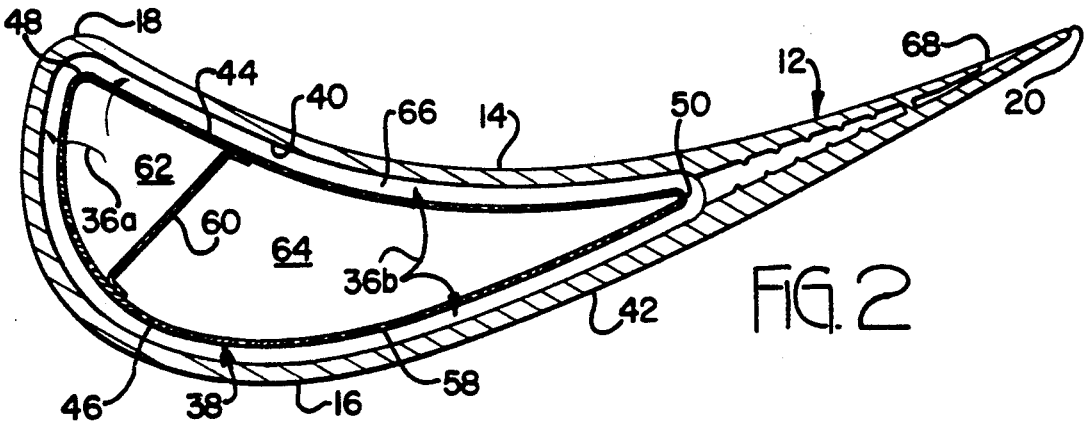
FIG. 2 is a transverse sectional view of one of the nozzle vanes illustrated in FIG. 1 including an impingement baffle therein taken along line 2—2.
Figure 3:
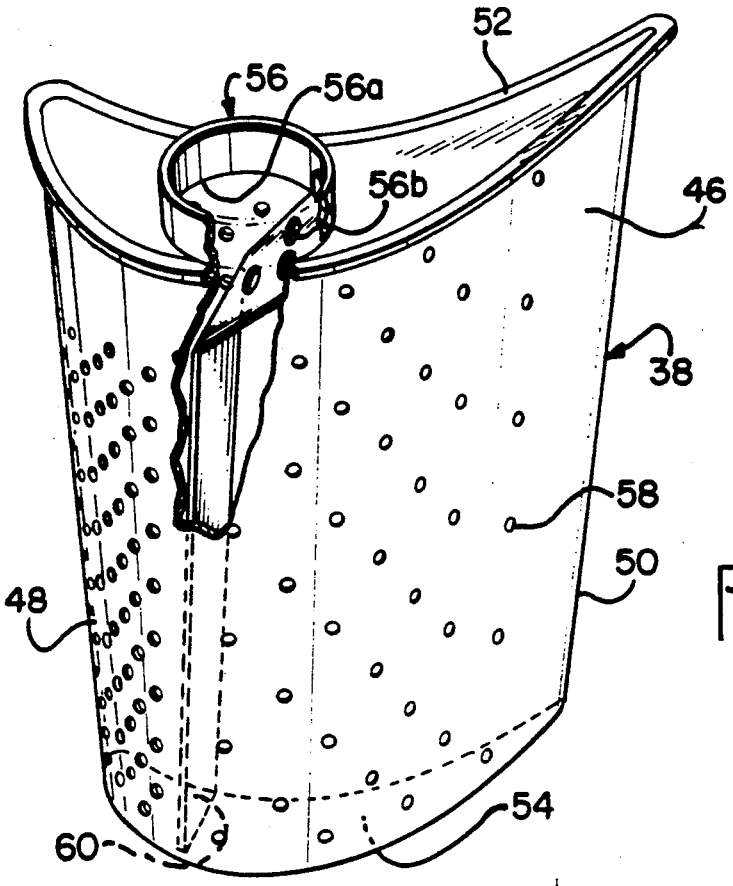
FIG. 3 is a perspective view of an exemplary impingement baffle used in the nozzle vane illustrated in FIGS. 1 and 2.

Referring to FIGS. 1, 2 and 3, the baffle 38 includes a first, or generally concave side 44 and a second, or generally convex side 46 joined together at a radially extending forward edge 48 and a radially extending aft edge 50. The baffle 38 also includes a generally flat top 52 in the exemplary form of a plate disposed at the radially outer end thereof, and a bottom 54 also in the exemplary form of a flat plate disposed at an opposite end thereof and radially inwardly of the top 52. The bottom 54 is preferably imperforate, and the top 52 is also preferably imperforate except for an inlet 56 in the exemplary form of a tubular collar or intake ring conventionally fixedly joined to the top plate 52 and disposed in the plenum 26 for receiving the compressed air 36 for flow through the baffle 38. The baffle first and second sides 44 and 46 include conventional impingement holes 58 which face the airfoil inner surface 40 for conventionally forming jets of the compressed air 36 directed against the airfoil inner surface 40 for the impingement cooling thereof. The impingement holes 58 are preferably sized and configured in accordance with a preferred embodiment of the present invention as described below for more effectively utilizing the compressed air 36 channeled into the baffle 38.

In accordance with one feature of the present invention, each of the baffle 38 includes a dividing wall or septum 60 extending radially between the baffle bottom 54 and top 52 and spaced axially between the baffle forward and aft edges 48 and 50 to define a forward manifold 62 extending from the septum 60 to the forward edge 48, and an aft manifold 64 extending from the septum 60 to the aft edge 50, with both manifolds 62, 64 also extending radially from the bottom 54 to the top 52. In order to save weight and provide for effective impingement cooling air performance, each airfoil 12 preferably includes only one of the baffles 38 therein, with the baffle forward manifold 62 being disposed adjacent to the airfoil leading edge 18, and the baffle aft manifold 64 being disposed in the mid-chord region between the forward manifold 62 and the airfoil trailing edge 20 without any intervening structures such as structural dividing ribs between the leading and trailing edges 18, 20. The airfoil 12 surrounds the baffle 38 and is conventionally spaced therefrom to define an impingement channel 66 therebetween as shown in FIG. 2, for example, into which channel 66 the spent impingement air is collected and channeled through conventional trailing edge apertures 68 as shown in FIGS. 1 and 2 and through conventional outlet apertures 70 in the inner shroud 28, for example, as shown in FIG. 1.

Figure 4:
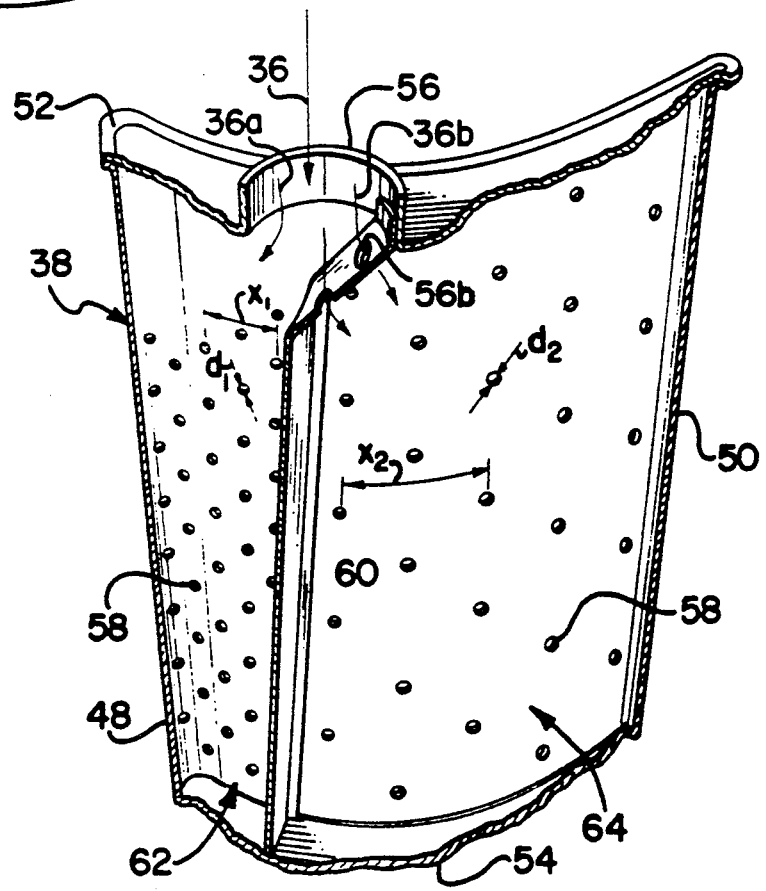
FIG. 4 is a longitudinal sectional view of the impingement baffle illustrated in FIG. 3.
Figure 5:
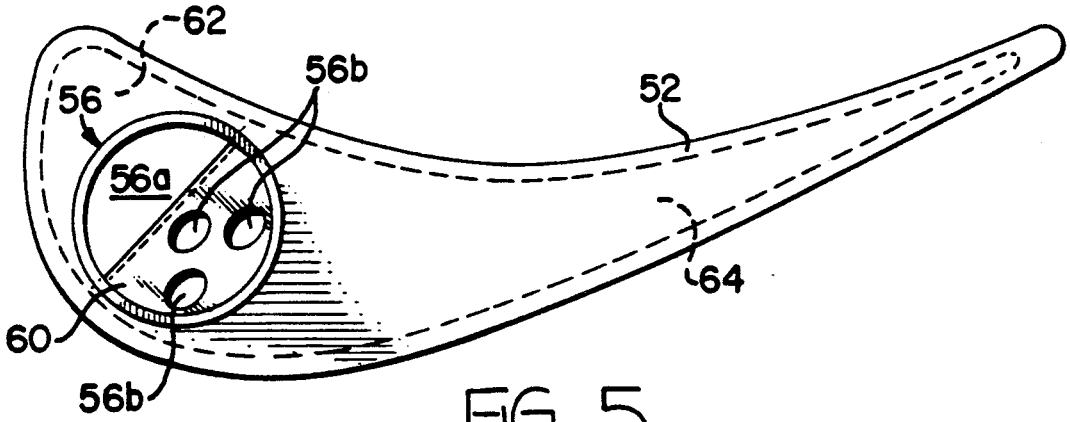
FIG. 5 is a top view of the impingement baffle illustrated in FIG. 3.

In the preferred embodiment, the baffle inlet 56 is a common inlet disposed at the baffle top 52 for channeling the compressed air 36 into the baffle 38 for direct flow to both the forward and aft manifolds 62 and 64 as shown in more particularity in FIGS. 4 and 5. More specifically, the inlet 56 includes a forward portion 56*a* defined between the baffle top 52 and the septum 60 which is disposed in flow communication with the forward manifold 62 for channeling a first portion 36*a* of the compressed air 36 directly into the forward manifold 62. The inlet 56 also includes an aft portion 56*b* disposed in flow communication with the aft manifold 64 for channeling a second portion 36*b* of the compressed air 36 directly into the aft manifold 64. In the preferred embodiment of the present invention the inlet aft portion 56*b* is sized and configured for providing a predetermined pressure drop in the compressed air second portion 36*b* as it flows therethrough so that the compressed air second portion 36*b* inside the aft manifold 64 is at a total pressure $P_2$ which is less than the total pressure $P_1$ of the compressed air first portion 36*a* inside the forward manifold 62.

Also in the preferred embodiment of the invention, the inlet aft portion 56*b* is in the form of a plurality of metering holes, three being shown, disposed in the top of the septum 60 adjacent the baffle top 52 which is otherwise imperforate for collectively channeling the compressed air second portion 36*b* into the aft manifold 64. The septum 60 is conventionally joined to a portion of the baffle top 52 in the inlet 56 by brazing for example. The septum 60 divides the baffle 38 into the two manifolds 62, 64 and divides the common inlet 56 into the forward portion 56*a* and the aft portion 56*b* for dividing the compressed air 36 therebetween. The inlet forward portion 56*a* is preferably sized for channeling the compressed air 36 into the forward manifold 62 at full pressure without appreciable pressure drop or obstruction which is accomplished in the embodiment illustrated by projecting the top portion of the septum 60 radially inwardly from the inner surface of the common inlet 56 without appreciably reducing the flow area of the compressed air 36 as it flows through the common inlet 56 and through the forward portion 56*a* into the forward manifold 52.

However, the flow area provided by the inlet aft portion 56*b* is smaller than that of the common inlet 56 to provide a predetermined pressure drop in the compressed air 36 as it flows through the inlet aft portion 56*b* and into the aft manifold 64. The inlet aft portion 56*b* in the form of a plurality of conventional metering holes has a relatively small collective flow area as compared to the flow area of the common inlet 56 to provide the required pressure drop as well as the required flow rate into the aft manifold 64. However, the inlet aft portion 56*b* may be a single hole.

The construction and operation of impingement baffles used in turbine nozzles is conventionally known with the compressed air 36 being typically provided at a single pressure into a single cavity impingement baffle. In such a conventional single cavity baffle, the density of the impingement holes is conventionally varied along the baffle sides and between the baffle leading and trailing edges to conventionally match the varying heat flux from the combustion gases 32 which heat the airfoil 12. For example, since the region of the airfoil leading edge 18 is conventionally known as a relatively high heat flux region, more cooling thereof is required as compared to regions downstream therefrom such as the mid-chord region extending toward the trailing edge 20 which are subject to a lower heat flux. In a conventional impingement baffle, the impingement holes 58 are suitably sized so that the single pressure of the supplied compressor air 36 effects a suitable impingement jet through the impingement holes 58 and against the inner surface 40 of the airfoil 12. As is conventionally known, the pressure differential or pressure ratio between the compressed air 36 on the inside of the baffle and the spent impingement air in the impingement channel 66 on the outside of the baffle 38 is preselected for forming suitable impingement jets against the airfoil inner surface 40. In a conventional single supply pressure, single pressure ratio impingement baffle, the impingement holes are suitably sized to ensure the generation of effective impingement jets, but this leads to either overcooling of regions of the airfoil 12 or increased hot and cold spots therein or a compromise therebetween as addressed in the Background Section.

More specifically, since the heat flux into the airfoil 12 varies along the outer surface 42 thereof and from the leading edge 18 having the highest heat flux to lower heat flux downstream therefrom, the requirement for cooling or heat transfer from the airfoil 12 also varies. In order to effectively cool the high heat flux regions such as near the leading edge 18, a predetermined relatively high density of the impingement holes 58 is required in that region and may be conventionally determined for each design. If the same high density of impingement holes 58 is made generally uniform over the entire baffle 38 from the forward edge 48 to the aft edge 50, the low heat flux regions disposed downstream from the airfoil leading edge 18 will necessarily be overcooled since they do not require as much cooling as the region at the leading edge 18. Accordingly, excessive amounts of the compressed air 36 will be used which decreases the overall efficiency of the gas turbine engine.

Alternatively, if the density of the impingement holes 58 is reduced in the low heat flux mid-chord region downstream of the leading edge 18 as compared to the high heat flux region adjacent to the leading edge 18, overcooling may be reduced or avoided in the low heat flux region of the airfoil 12, but with an increase in hot and cold spots which can reduce fatigue life of the airfoil 12. Each of the impingement holes 58 effects a relatively cold spot where it impinges against the inner surface 40 of the airfoil 12, with the airfoil inner surface 40 having a relatively hot spot between adjacent cold spots and impingement holes 58. In other words, a generally sinusoidal temperature distribution is effected in the airfoil 12 between adjacent impingement holes 58 with a resultant average temperature. Accordingly, the density of the impingement holes 58 may be reduced in low heat flux regions to reduce overcooling and achieve a predetermined average temperature of the airfoil 12, but with increased variation in local temperatures associated with the hot and cold spots. Such variation adversely affects airfoil fatigue life, and, therefore, compromises are typically made in the density of the impingement holes 58 subject to a single supply pressure of the compressed air 36 to provide varying hole density effective for cooling the airfoil 12 subject to high and low heat flux regions without either excessive overcooling thereof in the low heat flux regions or excessive hot and cold spots. Nevertheless, efficiency-decreasing overcooling of the low heat flux regions occurs and/or hot and cold spots reduce airfoil life.

However, by utilizing the bifurcated impingement baffle 38 described above, two different supply pressures and corresponding pressure ratios across the impingement holes 58 in the forward and aft manifolds 62 and 64 may be obtained for improving performance. More specifically, the compressed air first portion 36*a* provided to the forward manifold 62 is at a relatively high pressure $P_1$ compared to the pressure $P_2$ of the compressed air second portion 36*b* in the aft manifold 64. The inlet forward portion 56*a* is sized for providing the compressed air 36 into the forward manifold 62 with little or no pressure drop so that the maximum possible driving pressure is provided in the forward manifold 62 for driving the relatively high density impingement holes 58 therein for providing a relatively high heat transfer rate along the inner surface 40 of the airfoil 12 adjacent the leading edge 18 corresponding to the region of high heat flux in the airfoil 12. In this way the high heat flux region of the airfoil 12 may be conventionally cooled with full pressure compressed air 36.

By utilizing the inlet aft portion 56*b* predeterminedly sized to meter the compressed air second portion 36*b* into the aft manifold 64 to decrease its pressure $P_2$, a lower driving pressure is provided therein which effects a pressure ratio between the aft manifold 64 and the impingement channel 66 which is less than the pressure ratio between the forward manifold 62 and the impingement channel 66. Of course, the impingement holes 58 are also conventionally sized to effect the desired pressure ratios. By providing a greater pressure ratio across the impingement holes 58 of the forward manifold 62 as compared to the pressure ratio across the impingement holes 58 of the aft manifold 64 by decreasing the aft manifold pressure $P_2$, more efficient use of the compressed air 36 is obtained for suitably cooling both the high heat flux region of the airfoil 12 opposite the forward manifold 62 and the low heat flux region of the airfoil 12 opposite the aft manifold 64 without excessive amounts of the compressed air 36 or overcooling of the low heat flux region. The impingement holes 58 of the forward manifold 62 are conventionally sized and configured with a conventional density for effecting an average convective heat transfer rate on the airfoil inner surface 40 adjacent the leading edge 18 which is greater opposite the forward manifold 62 than the heat transfer rate opposite the aft manifold 64. Since the heat transfer rate is proportional to the pressure ratio across the impingement holes 58, the lower pressure $P_2$ of the compressed air second portion 36*b* inside the aft manifold 64 results in a lower heat transfer rate which corresponds to the lower heat flux experienced by the airfoil 12 opposite the aft manifold 64.

In an exemplary embodiment as shown in FIG. 4, the impingement holes 58 of the forward manifold 62 have a diameter $d_1$ and are spaced apart at a distance $x_1$ on centers, and the impingement holes 58 of the aft manifold have a diameter $d_2$ and a spacing $x_2$. In one embodiment, the diameters $d_1$ and $d_2$ of the impingement holes 58 may be equal. The spacing-to-diameter ratios $x_1/d_1$ and $x_2/d_2$ are also conventional within a range of about 2 to about 16. And, the density of the impingement holes 58, i.e., the number of holes 58 per unit area of the baffle 38 may be conventionally determined given the different pressures within the forward and aft manifolds 62 and 64. Since less heat flux is associated with the aft manifold 64 than that associated with the forward manifolds 62, the average density of the impingement holes 58 may be preferably greater in the forward manifold 62 than in the aft manifold 64. Of course, as is conventionally known, the density of the impingement holes 58 may also be varied locally along the baffle 38 as required to tailor cooling of the airfoil 12 in response to the varying heat flux experienced therein during operation. However, by using different supply pressures and pressure ratios in accordance with the invention both overcooling and hot and cold spot differences may be decreased in the low heat flux region.

More specifically, the bifurcated baffle 38 of the present invention allows several possible improvements over the single cavity baffle of the prior art. For example, relative to a prior art baffle having a reduced density of impingement holes in the trailing edge region for a single supply pressure (e.g. $P_1$), the baffle 38 may have an increased density of the impingement holes 58 associated with the aft manifold 64 at a lower pressure $P_2$ which increases the collective flow area through the impingement holes 58 which, therefore, reduces the intensity of the individual impingement jets therefrom at a closer spacing $x_2$ therebetween. This results in a more uniform convective heat transfer from the airfoil inner surface 40 opposite the aft manifold 64 without an increase in total flow through the impingement holes 58 which would otherwise occur if the pressure $P_2$ in the aft manifold 64 were the same as the pressure of the supplied compressor air 36. The more uniform convective heat transfer rate reduces the magnitude of the hot and cold spots associated with the impingement holes 58 while still obtaining a predetermined average temperature of the airfoil 12 opposite the impingement holes 58.

Alternatively, the density of the impingement holes 58 associated with the aft manifold 64 may remain identical to that for a conventional impingement baffle without the septum 60, but in view of the reduced pressure $P_2$ in the aft manifold 64, a reduced flow rate of the compressed air 36 will be channeled through the aft manifold 64 for reducing total flow without overcooling, which increases efficiency.

And, of course, the full supply pressure of the compressed air 36 may continue to be supplied to the forward manifold 62 for accommodating the relatively high heat flux associated therewith without subjecting the aft manifold 64 to the same full pressure compressed air 36 and resulting full intensity impingement jets from the impingement holes 58.

In view of the improved performance of the aft manifold 64, which effectively cools the airfoil 12 without overcooling or undesirable hot and cold spots, the airfoil 12 is preferably imperforate, or characterized by the absence of film cooling holes therethrough, from adjacent the septum 60 to adjacent the baffle aft edge 50 as shown in FIG. 2. In this way the outer surface of the airfoil 12 is not film cooled from adjacent the septum 60 to adjacent the baffle aft edge 50. In conventional practice, the magnitude of the hot and cold spots associated with baffle impingement holes downstream of the leading edge 18 may be reduced by alternatively using conventional film cooling holes through the airfoil 12 in conjunction with baffle impingement holes. By suitably positioning the film cooling holes in the airfoil 12 generally opposite the baffle impingement holes in the low heat flux region, the otherwise increased magnitude of hot and cold spots associated with the decreased number of baffle impingement holes may be reduced. However, the film cooling holes increase complexity and costs of manufacture, and, themselves, require an additional amount of the compressed air 36, which may be eliminated in accordance with one feature of the invention by providing the imperforate airfoil 12.

The airfoil 12 adjacent the leading edge 18 and opposite the forward manifold 62 may, however, include film cooling holes (not shown) in a conventional fashion for providing any additional required cooling capability for the high heat flux region associated with the leading edge 18.

As described above, the airfoil 12 is in the exemplary form of a stator vane, with the baffle inlet 56 being disposed at the radially outer end thereof for directly receiving the compressed air 36 channeled to the plenum 26 as shown in FIG. 1. Also in the preferred embodiment, the airfoil 12 is a second stage stator vane which is subjected to a lower heat flux as compared to the stage-one nozzle (not shown) disposed upstream of the stage-one turbine 30. Since the stage-one nozzle is subjected to the highest heat flux from the combustion gases 32 discharged directly from the combustor (not shown) the stage-one nozzle vanes typically include film cooling apertures conventionally spaced between their leading and trailing edges in addition to an impingement baffle therein. In such a configuration, the baffle septum 60 would ordinarily not be required or desirable since the film cooling holes may be conventionally positioned relative to the baffle impingement holes for reducing the hot and cold spots discussed above without the need for the bifurcated baffle 38.

While there have been described herein what are considered to be preferred embodiments of the present invention, other modifications of the invention shall be apparent to those skilled in the art from the teachings herein, and it is, therefore, desired to be secured in the appended claims all such modifications as fall within the true spirit and scope of the invention.

For example, although the impingement baffle 38 disclosed above includes two manifolds, three or more manifolds, each having a different supply pressure therein may also be used as required. The manifolds within the baffle 38 may be axially spaced apart as described above, or could, alternatively, be radially spaced apart, or combinations thereof.

Furthermore, the impingement baffle 38 may be conventionally manufactured by casting, forging, or brazed sheet metal. The baffle sides 44 and 46 and the septum 60 could be a single, unitary member, or may be two members with the septum 60 having a generally U-shaped transverse section conventionally brazed to the baffle sides 44 and 46 as shown in FIG. 2.

Yet further, the inlet 56 including the portions **56*a*, 56*b* may take other forms to provide substantially unobstructed flow without appreciable pressure drop into the forward manifold 62, and partially obstructed flow to provide a predetermined pressure drop into the aft manifold 64 so that the pressure ratio across the impingement holes 58 of the low heat flux region aft manifold 64 is less than that across those of the high heat flux region forward manifold 62**.

Accordingly, what is desired to be secured by Letters Patent of the United States is the invention as defined and differentiated in the following claims:

1. An apparatus comprising:

a hollow baffle having first and second sides joined together at a forward edge and at an aft edge, a top, and a bottom;

a septum extending between said baffle bottom and top and spaced between said forward and aft edges to define a forward manifold extending from said septum to said forward edge, and an aft manifold extending from said septum to said aft edge;

an inlet disposed at said top for channeling compressed air into said baffle, said inlet including a forward portion disposed in flow communication with said forward manifold for channeling a first portion of said compressed air directly into said forward manifold, and an aft portion disposed in flow communication with said aft manifold for channeling a second portion of said compressed air directly into said aft manifold, said inlet aft portion being sized for providing a predetermined pressure drop in said compressed air second portion so that said compressed air second portion inside said aft manifold is at a pressure less than that of said compressed air first portion inside said forward manifold; and said baffle first and second sides include impingement holes for discharging said compressed air from said forward and aft manifolds.

2. An apparatus according to claim 1 wherein said inlet aft portion is disposed in said septum adjacent said baffle top.

3. An apparatus according to claim 2 wherein said inlet aft portion includes a plurality of apertures for collectively channeling said compressed air second portion into said aft manifold.

4. An apparatus according to claim 3 further including:

an airfoil surrounding said baffle and spaced therefrom to define an impingement channel therebetween, said airfoil having an inner surface facing said baffle impingement holes for being impingement cooled by said compressed air first and second portions, and an outer surface facing away from said impingement holes; and said inlet aft portion being sized for providing a pressure ratio between said aft manifold and said impingement channel which is less than a pressure ratio between said forward manifold and said impingement channel.

5. An apparatus according to claim 4 wherein said airfoil includes concave and convex sides being imperforate from adjacent said baffle septum to adjacent said baffle aft edge.

6. An apparatus according to claim 5 wherein said airfoil includes only one of said baffles, and said baffle forward manifold is disposed adjacent to a leading edge of said airfoil, and said baffle aft manifold is disposed in a mid-chord region of said airfoil.

7. An apparatus according to claim 6 wherein said airfoil is subject to a heat flux being greater adjacent said leading edge than adjacent said mid-chord region, and said baffle impingement holes are sized and configured for effecting a heat transfer rate on said airfoil inner surface being greater opposite said forward manifold than opposite said aft manifold.

8. An apparatus according to claim 6 wherein said baffle impingement holes have an average density being greater in said forward manifold than in said aft manifold.

9. An apparatus according to claim 6 wherein said airfoil is a stator vane.

* * * * *